US007387071B2

(12) United States Patent
Heinke et al.

(10) Patent No.: US 7,387,071 B2
(45) Date of Patent: Jun. 17, 2008

(54) BLASTING METHOD AND BLASTING ACCESSORY

(75) Inventors: Nils Alberto Heinke, Elkins, WV (US); Roger Dean Skaggs, Bonne Terre, MO (US); Stephen Mitchell Collinsworth, Stanton, KY (US)

(73) Assignee: International Technologies, LLC, Elkins, WV (US)

( * ) Notice: Subject to any disclaimer, the term of this patent is extended or adjusted under 35 U.S.C. 154(b) by 0 days.

(21) Appl. No.: 10/574,324

(22) PCT Filed: Sep. 30, 2004

(86) PCT No.: PCT/IB2004/003194

§ 371 (c)(1),
(2), (4) Date: Apr. 23, 2007

(87) PCT Pub. No.: WO2005/033474

PCT Pub. Date: Apr. 14, 2005

(65) Prior Publication Data

US 2007/0272108 A1 Nov. 29, 2007

(30) Foreign Application Priority Data

Oct. 3, 2003 (ZA) ..... 2003/7749

(51) Int. Cl.
*F42D 3/00* (2006.01)

(52) U.S. Cl. ..... 102/313; 102/333; 299/13

(58) Field of Classification Search ..... 102/304, 102/333, 313
See application file for complete search history.

(56) References Cited

U.S. PATENT DOCUMENTS

| | | | | | |
|---|---|---|---|---|---|
| 351,273 | A | * | 10/1886 | Learnard | 102/333 |
| 465,410 | A | * | 12/1891 | Knox | 102/333 |
| 2,047,774 | A | * | 7/1936 | Greene | 102/333 |
| 2,449,511 | A | * | 9/1948 | Russell | 102/200 |
| 3,366,056 | A | * | 1/1968 | Thunell et al. | 102/333 |
| 4,919,203 | A | | 4/1990 | Fitzgibbon, Jr. | |
| 7,052,092 | B2 | * | 5/2006 | Collinsworth et al. | 299/13 |

FOREIGN PATENT DOCUMENTS

| | | |
|---|---|---|
| WO | WO 00/60301 | 10/2000 |
| WO | WO 02/42711 A1 | 5/2002 |
| WO | WO 03/014045 A2 | 2/2003 |
| WO | WO 03/060290 A1 | 7/2003 |

* cited by examiner

*Primary Examiner*—Michael J. Carone
*Assistant Examiner*—Gabriel J Klein
(74) *Attorney, Agent, or Firm*—Cozen O'Connor

(57) ABSTRACT

A drill hole (350) extends into rock to be blasted. A blasting accessory (310) includes a container portion (312) for holding a predetermined volume of stemming material, and a spacer (330) for spacing the stemming material a predetermined distance from a surface, e.g. a blind bottom of the drill hole. The container portion has a top (320) surrounded by a dilatable, inverted skirt forming a seal (342), and forms a support for a blasting substance like an explosive.

11 Claims, 5 Drawing Sheets

BLASTING METHOD AND BLASTING ACCESSORY

This application is a National Phase filing under 35 U.S.C. § 371 of International PCT application no. PCT/IB2004/003194 filed on 30 Sep. 2004 which claims priority to South African Patent Application No. ZA 2003/7749 filed on Oct. 3, 2003, each of which is hereby incorporated by reference in its entirety.

THIS INVENTION relates to a method of blasting or rock breaking, and to an accessory for use in blasting or rock breaking.

This invention is expected to be applicable particularly advantageously in the field of mining, but it is not limited to that field.

For purposes of this specification, the terms "blasting" and "explosive" and derivatives are used for convenience. Unless the context indicates otherwise, those terms should be interpreted widely, to incorporate also the general meanings respectively of blowing up rocks or other destructive actions by means of agents other than explosives, e.g. also by means of a propellant; and of a destructive agent other than an explosive, e.g. including also a propellant.

In accordance with a first aspect of this invention, there is provided a method of blasting or breaking rock or other materials by means of pressure/shock waves generated in a tamped drill hole, the method including forming a stemming plug by holding a stemming material in a container at a predetermined spacing from a surface by means of a frangible spacer abutting said surface and corresponding to said predetermined spacing and being connected to the container, the container and the spacer forming a sacrificial blasting accessory;

locating a pressure generating or shock wave generating substance adjacent the container remote from said surface;

initiating said pressure generating or shock wave generating substance to cause the stemming material to be displaced at speed toward said surface.

The pressure or shock waves may be generated by an explosive proper, instead, by a propellant or other pressure generating or shock wave generating substance.

The container may be closeable and may have a defined volume for containing a correspondingly defined volume of stemming material.

The method may be performed in a drill hole which extends downwardly, the blasting accessory having a profile slightly smaller than a diameter of the drill hole, the method then including causing the blasting accessory to fall under gravity toward said surface.

Preferably, the method may include providing a dilatable seal formation in conjunction with the container, the method including dilating the seal formation to block the drill hole when the seal formation is in position, and locating a pressure or shock wave generating substance at said position in the drill hole. The seal formation may be in the form of an inverted skirt, the method including flaring the skirt to cause sealing by pressure exerted by or via the pressure or shock wave generating substance.

The method may include adjusting an effective length of the spacer in accordance with a desired spacing from said surface.

In accordance with a second aspect of the invention, there is provided a blasting accessory suitable for use in a drill hole, the accessory including a container which is closable for holding a predetermined volume of stemming material in the form of a plug;

a spacer proximate the container and extending away from the container a predetermined distance, the spacer having a free end remote from the container for abutting a surface in use.

The container may include an openable and closable closure.

The blasting accessory may be round and may have a profile which is of a predetermined diameter commensurate with a diameter of a drill hole for which the accessory is intended, i.e. to be slidable snugly along the drill hole. The blasting accessory may thus be of generally round tubular shape, the spacer being in the form of a tube having an open free end, and a vent hole remote from the free end. The container too may be tubular to fit spigot-socket fashion over or within an end of the spacer, e.g. similarly to two portions of a pharmaceutical capsule. Thus, one end portion of the container may be a securing end portion and may be in the form of an open-ended sleeve fitting over an end of the spacer. Instead, it may be in the form of a spigot fitting within a socket at an end or the spacer.

An opposed end portion of the container may be a container end portion and may be closable to hold the stemming material, the opposed end portions of the container being divided by means of an internal shoulder arranged to abut the spacer to set the depth of overlapping and thus the volume of the container. The container end portion may have a larger diameter to cause it to fit snugly within the drill hole.

In a preferred embodiment, by way of development, the blasting accessory may include a deformable seal formation in the form of a rim for sealing against an inner periphery of the drill hole to form a plunger for holding a pressure generating or shock wave generating substance adjacent the container remote from the spacer. The deformable rim may be in the form of an inverted skirt having longitudinal slits to render it deformable or to facilitate deformation.

The accessory may be suitable for use in "wet" drill holes, i.e. drill holes containing water at their bottoms, the spacer then having small volume so as to displace the water at the bottom of the drill hole minimally. The stem may be in the form of an open ended tube.

The accessory may be in the form of a moulding of synthetic polymeric material. It may be in the form of an injection moulding.

The invention is now described by way of example with reference to the accompanying diagrammatic drawings. In the drawings FIG. 1 shows, in sectional, dismantled view, an accessory in accordance with the invention;

Figure 1:
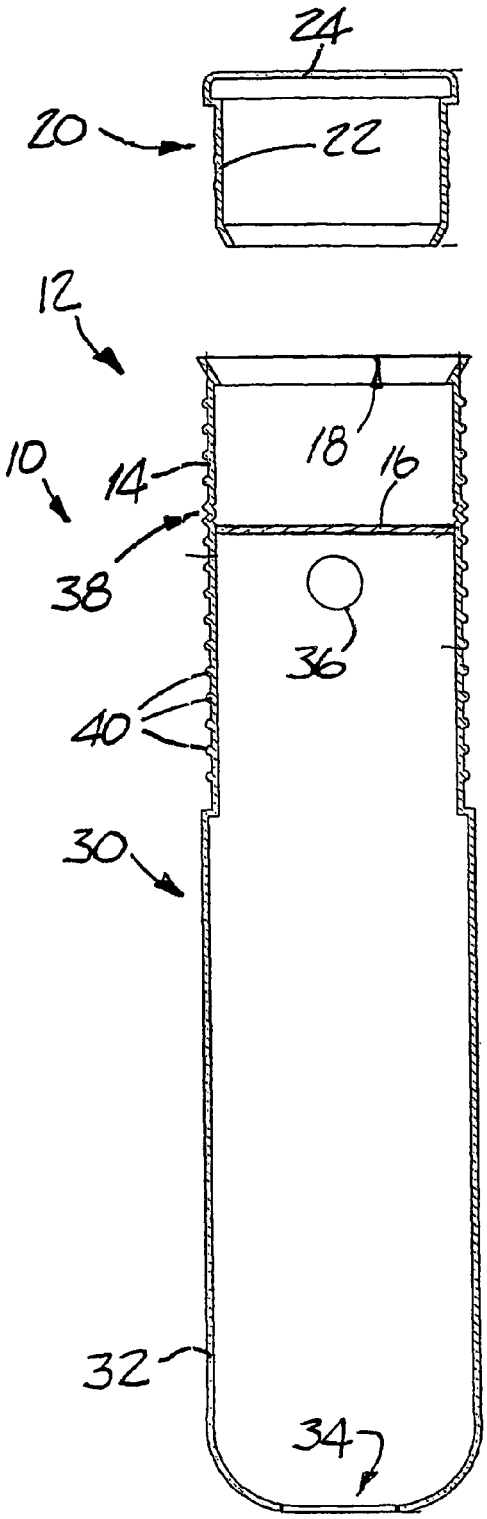

With reference to FIG. 1 of the drawings, an accessory in accordance with the invention is generally indicated by reference numeral 10. The accessory is suitable for use in blasting operations in a drill hole.

The accessory 10 is generally of round tubular shape comprising a container generally indicated by reference numeral 12, and a spacer generally indicated by reference numeral 30, the container 12 and the spacer 30 being provided in series. It further comprises a lid, generally indicated by reference numeral 20, for the container 12.

The container 12 is formed within a tubular wall 14 above a transverse floor 16 extending across the tubular wall 14. The tubular wall 14 is open ended opposite to the floor 16, as indicated by reference numeral 18.

The lid 20 has a sleeve 22 snugly, frictionally receivable within the tubular wall 14. The lid 20 has a closed top 24. A lower, open end of the sleeve 22 has a convergent end portion complemental to a divergent end portion of the open top 18 to facilitate inserting the sleeve 22 within the tubular wall 14 to close the container 12.

The tubular wall 14 extends into the spacer 30 past the level of the floor 16 and blends into a smooth tube 32 connected to the extended tubular wall 14 at a shoulder 42. The tube 32 is open-ended at its bottom as indicated by reference numeral 34. Complementally, the tubular spacer 30 has, at a high level, a vent hole 36.

In use, it is desired to have a plug of stemming material spaced a predetermined distance from a predetermined surface, for example a bottom, of a drill hole. The effective length of the spacer 30 corresponds to the desired spacing, the open bottom 34 abutting the predetermined surface. Stemming material, for example in the form of drill cuttings, is contained within the container 12. Because of the defined volume of the container 12, a correspondingly defined volume of stemming material will be provided if the container is filled.

The closed top 24 of the lid 20 provides a platform for supporting material to be placed on the accessory 10, for example for a pressure generating or shock wave generating substance such as an explosive.

The open bottom 34 of the tube 32, and the vent hole 36 allow the accessory 10 to be used in "wet" drill holes in that the spacer 30 which is only slightly narrower than the drill hole, would not unduly displace water in the drill hole away from the bottom of the drill hole. Thus, water will be contained within the spacer 30 below the floor 16 of the container 12. This will prevent an explosive to be charged from being wetted by rising water.

By way of development the tubular wall portion 14 and the extended wall portion have peripheral beads 38 extending around the tubular wall portion at the level of the floor 16. In addition, circumferentially intermittent ridges 40 are formed at longitudinally spaced positions externally on the tubular wall 14.

Figure 2:
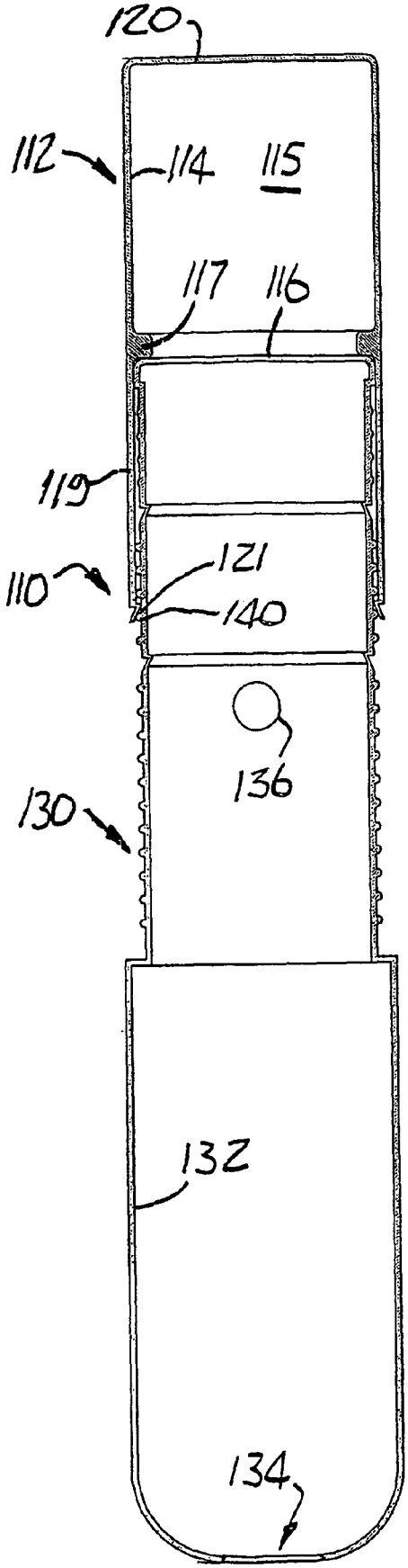
FIG. 2 shows, in a view corresponding to FIG. 1 but in assembled form, another embodiment of an accessory in accordance with the invention.

With reference to FIG. 2, a further embodiment of an accessory in accordance with the invention is generally indicated by reference numeral 110. The accessory 110 is, in may respects, similar to the accessory 10 of FIG. 1 and like reference numerals are generally used to denote like features. Furthermore, all of the features are not again described and emphasis is merely placed on differences or developments.

A first difference is that the spacer 130 is extended incorporating an upper portion integral with the extended tubular wall and having a closed top 116.

The container 112 is separate from and apart of the spacer 130. The container 112 is of generally tubular form having a tubular wall 114 which extends into a coaxial tubular skirt 119. An internal peripheral shoulder 117 is provided intermediate the tubular walls 114 and 119. It has a closed top 120.

The tubular sleeve 119 fits snugly over the upper portion of the tubular wall of the spacer 130, the overlap being determined by the longitudinal position of the internal shoulder 117 abutting against the top or floor 116 of the spacer 130. The sleeve 119 has, at its bottom, a peripheral hook formation 121 hooking underneath an appropriate one of the intermediate ridges 140 to prevent the container 112 from being withdrawn inadvertently.

Thus, a closed container portion 115 is formed within the peripheral wall 114 intermediate the floor 116 and closed top 120, while the effective length or spacing is the distance between the floor 116 and the open bottom 134 of the spacer 130.

In use, the container 112 is inverted and is filled with stemming material, for example drill cuttings, from the closed top (which is a closed bottom when inverted) to the level of the shoulder 117. While being kept inverted, the spacer 130 is placed in position within the sleeve 119. The accessory 110 can then be oriented as required because the container volume 115 remains closed and the stemming material, to the predetermined volume, remains intact.

When the accessory 110 is placed within a drill hole, the bottom 134 abuts a predetermined surface within the drill hole, for example a bottom of the drill hole thus spacing the stemming material in the container 115 the predetermined spacing from said predetermined surface. The closed top 120 then acts as a base for supporting other material, for example an explosive.

Figure 3:
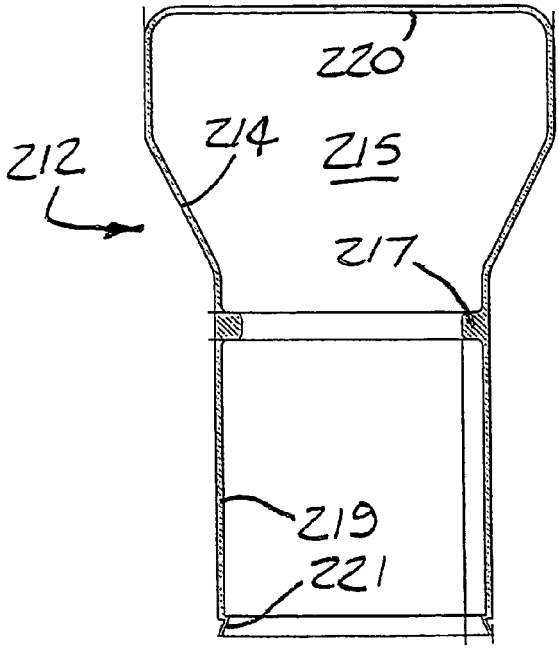
FIG. 3 shows, in section view, a variant embodiment of a container for the accessory of FIG. 2.

With reference to FIG. 3, a variant container 212 which can replace the container 112 of FIG. 2 has a partially diverging peripheral wall 214 blending into a parallel portion and terminating in the closed top 220. The container volume 215 will generally be larger than the container volume 115 of FIG. 2. Furthermore, the diameter of the closed top 220 is larger thus being appropriate for a larger drill hole.

Figure 4:
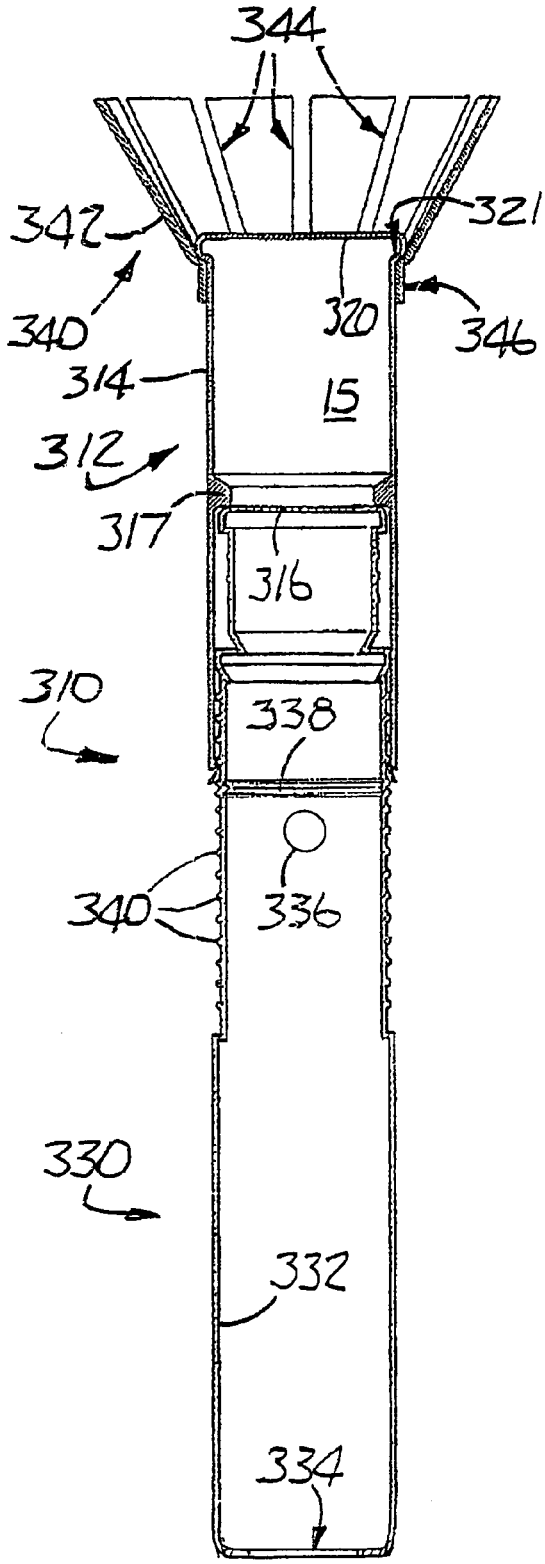
FIG. 4 shows yet a further, developed embodiment of an accessory in accordance with the invention in a view corresponding to the view of FIG. 2.

With reference to FIG. 4, a developed embodiment of an accessory in accordance with the invention is generally indicated by reference numeral 310. The embodiment 310 is very similar to the embodiment of FIG. 2, with two differences. First, the tubular wall 314 of the container bulges peripherally outwardly to form a peripheral bead 321 adjacent an integral closed top 320. Secondly, and more importantly, the accessory 310 comprises a peripheral seal member generally indicated by reference numeral 340. The seal member 340 is in the form of an inverted skirt 342 divided by longitudinal slits 344. It has a narrow collar or sleeve 346 fitting snugly, with interference, over the peripheral bead 321 thus to retain it in position.

The peripheral seal 340 allows the accessory 310 to be substantially smaller than a drill hole for which it is intended, thus to allow the accessory 310 to be moved easily into the drill hole, for example under gravity in the case of a downwardly extending, such as a vertically downwardly extending, drill hole. The inverted skirt 342 is easily shrinkable and also dilatable, as facilitated by the longitudinal slits 344.

Figure 5:
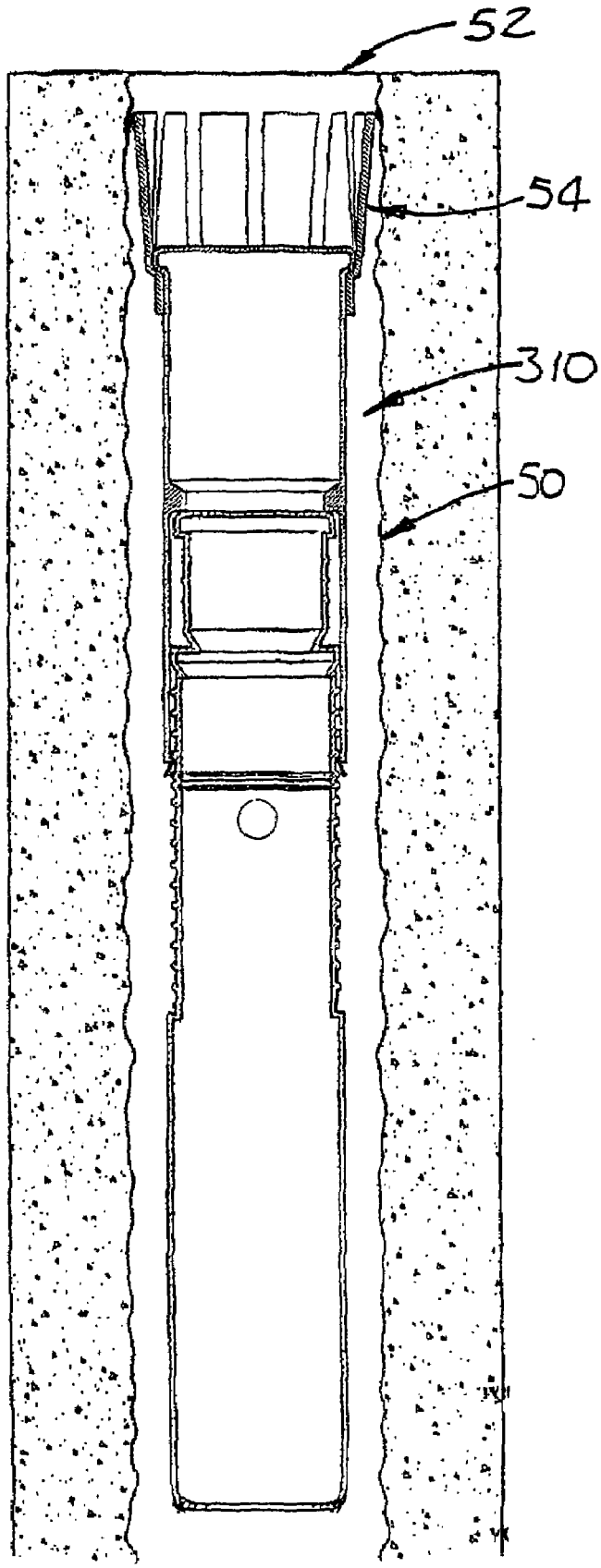
FIGS. 5 and 6 show, in sectional views, the accessory of FIG. 4 located respectively in a relatively narrow and in a relatively wide drill hole.

With reference to FIG. 5, the accessory 310 is shown in position within a drill hole 50 which is of relatively narrow diameter. Thus, as shown by reference numeral 54, the inverted skirt 342 of the peripheral seal member 340 is radially shrunk or compressed to fit snugly within the drill hole 50. Thus, when material is passed through an open end 52 of the drill hole, the material will be checked by and supported by the peripheral seal member 340.

Figure 6:
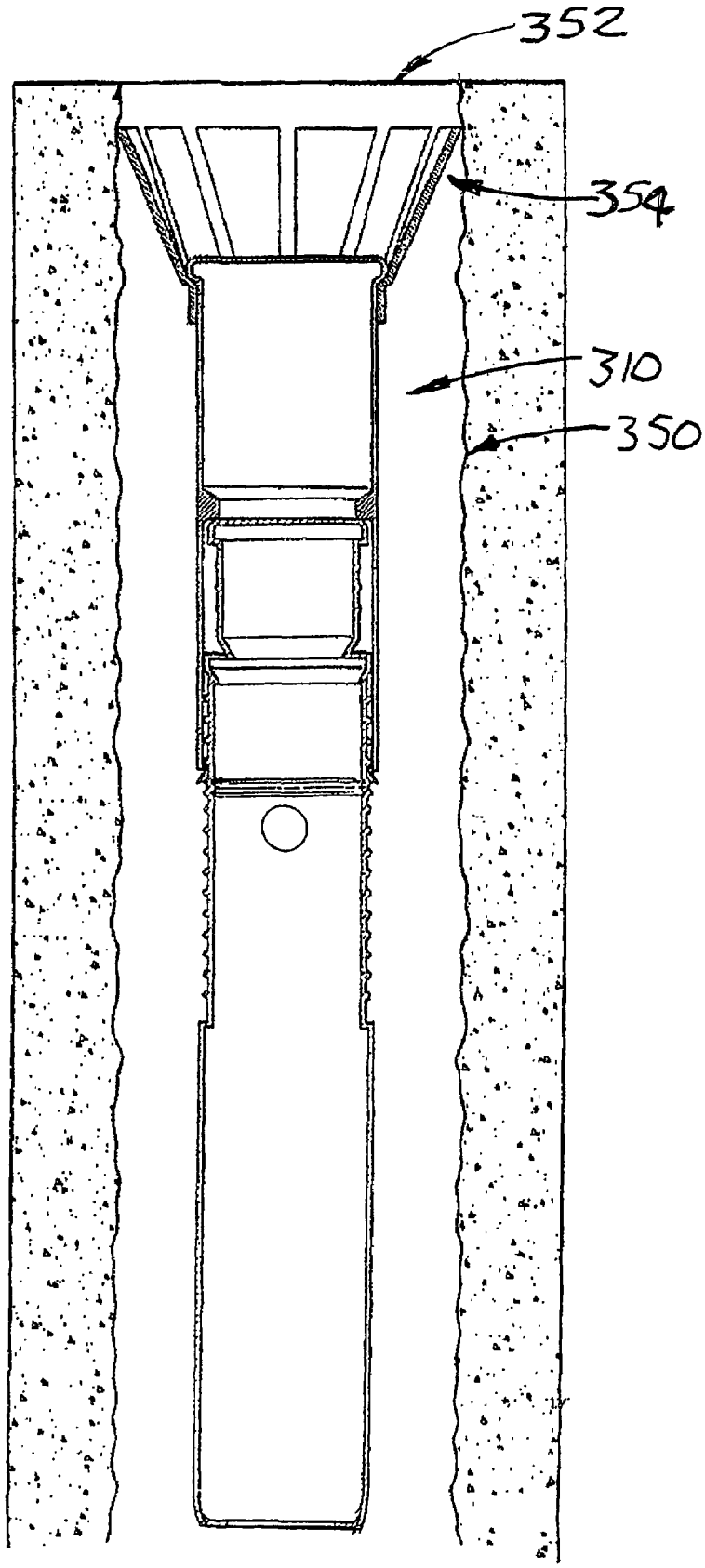

FIG. 6 shows the accessory 310 in a relatively wide drill hole 350 in which the peripheral seal member 354 remains substantially radially dilated as indicated.

In use, and with reference especially to FIGS. 5 and 6, an explosive is supported on the accessory 310 and the peripheral seal member 340 prevents the explosive from flowing annularly past the lower portion of the accessory 310 into the drill hole. The explosive is thus located immediately above the stemming material within the container, which is spaced above the bottom or other predetermined surface of the drill hole.

Figure 7:
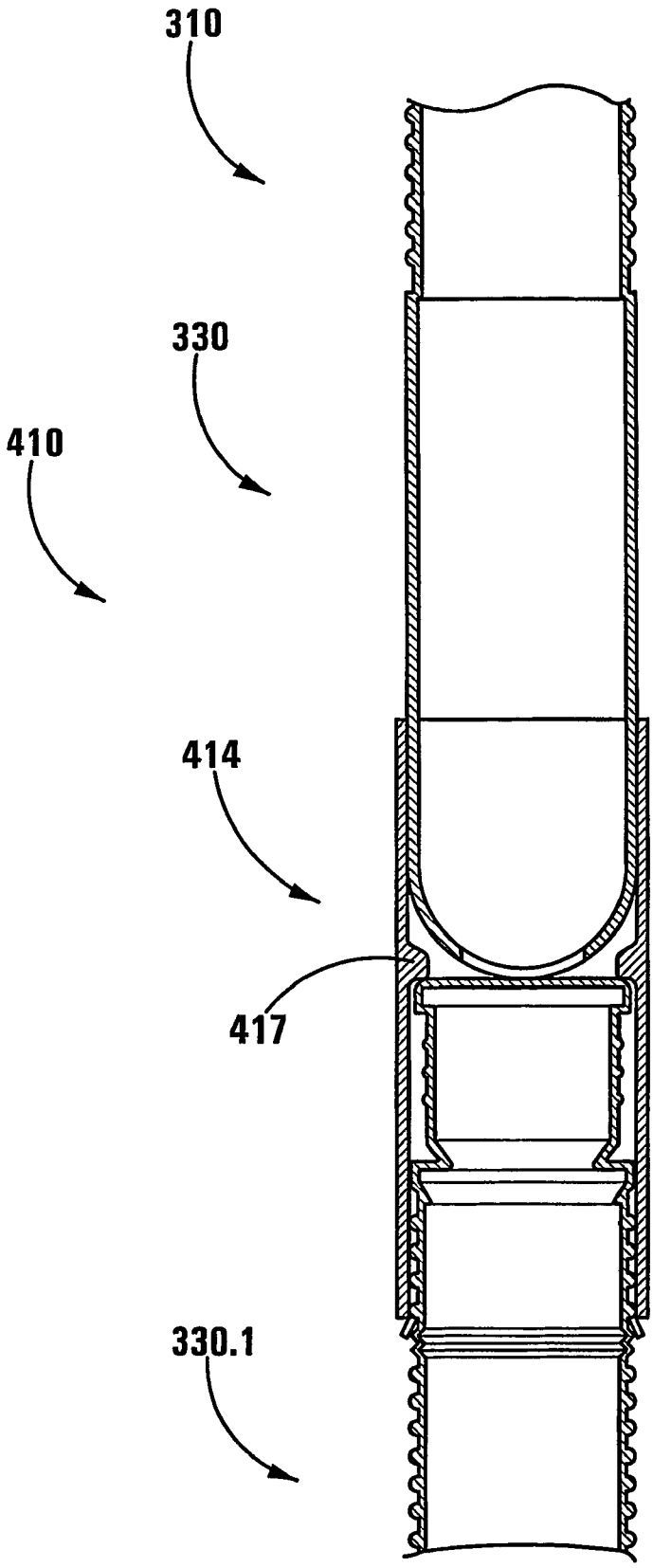
FIG. 7 shows, in sectional view, fragmentarily, the accessory of FIG. 4, extended.

With reference to FIG. 7, the accessory 310 of FIG. 4 is extended by means of a second spacer 330.1 arranged in series with the initial spacer 330 and secured to the initial spacer 330 by means of a sleeve 414 having an intermediate, inwardly directed, peripheral shoulder 417 and oppositely extending socket formations received over, respectively, the lower end portion of the initial spacer 330, and the upper end portion of the second spacer 330.1. In this fashion, the accessory 410 is provided with an extended stem or spacer to space it further from the bottom of the drill hole. It is to be appreciated that even more spacers may be used in a similar fashion to extend the accessory even more. This allows selection, within a virtually unlimited range, in discrete steps, of the length at which the stemming material is spaced.

It is an advantage that a predetermined volume of stemming material can be spaced at a predetermined distance above a surface and that a pressure generating or shock wave generating blasting substance such as an explosive can be supported immediately above the stemming material in accordance with this invention. The predetermined distance can be selected within a wide range in discrete steps.

The invention claimed is:

1. A method of blasting or breaking rock or other materials by means of pressure/shock waves generated in a tamped drill hole, the method including forming a stemming plug by holding a stemming material in a container at a predetermined spacing from a surface by a bottom of the drill hole by means of a frangible spacer abutting said surface and corresponding to said predetermined spacing and being connected to the container, the container and the spacer forming a sacrificial blasting accessory;

locating a pressure generating or shock wave generating substance adjacent the container remote from the bottom;

initiating said pressure generating or shock wave generating substance to cause the stemming material to be displaced at speed toward the bottom, characterized in that the container is of a defined volume and includes a openable and closable closure and by the initial method step of filling, in use, the container with a correspondingly defined volume of stemming material and closing the container by means of the openable and closable closure.

2. A method of blasting or breaking rock or other materials as claimed in claim 1 which is performed in a drill hole which extends downwardly, in which the blasting accessory has a profile slightly smaller than a diameter of the drill hole, the method further including causing the blasting accessory to fall under gravity toward the bottom.

3. A method of blasting or breaking rock or other materials as claimed in claim 1, in which a dilatable and shrinkable seal formation is provided in conjunction with the container, the method further including blocking the drill hole by means of said dilatable and shrinkable seal formation when the seal formation is in position, locating a pressure or shock wave generating substance at said position on the drill hole, and checking and supporting said shock wave generating substance by the seal formation.

4. A method of blasting or breaking rock or other materials as claimed in claim 3 in which the seal formation comprises an inverted skirt, the method further includes flaring the skirt to cause sealing by pressure exerted by or via the pressure or shock wave generating substance.

5. A method of blasting or breaking rock or other materials as claimed in claim 1, which includes adjusting an effective length of the spacer in accordance with a desired spacing from said surface.

6. A blasting accessory suitable for use in a drill hole, the accessory including a container for holding stemming material in the form of a plug;

a spacer connected to the container and extending away from the container a predetermined distance, the spacer having a free end remote from the container for abutting a surface formed by a bottom of the drill hole in use; characterized in that the container has a defined volume and includes an openable and closable closure to allow the container to be filled, in use, with a correspondingly defined volume of the stemming material and to be closed by means of the closure the blasting accessory further comprising a deformable seal formation in the form of a rim for sealing against an inner periphery of the drill hole to form a plunger for holding a pressure generating or shock wave generating substance adjacent the container and remote from the spacer.

7. A blasting accessory as claimed in claim 6 which is of generally round tubular shape, the spacer being in the form of a tube having an open free end, and a vent hole remote from the free end.

8. A blasting accessory as claimed in claim 7 in which the container is tubular and fits spigot-socket fashion over or within an end of the spacer.

9. A blasting accessory as claimed in claim 8 in which one end portion of the container is a securing end portion and is in the form of an open-ended sleeve fitting over an end of the spacer.

10. A blasting accessory as claimed in claim 9 in which an opposed end portion of the container is a container end portion and is closable to hold the stemming material, the opposed end portions of the container being divided by means of an internal shoulder arranged to abut the spacer to set the depth of overlapping and thus the volume of the container.

11. A blasting accessory as claimed in claim 6 in which the deformable rim is in the form of an inverted skirt having longitudinal slits to render it deformable or to facilitate deformation, in respect of both shrinking and dilating.

* * * * *